US008081914B2

(12) United States Patent
Ruiz et al.

(10) Patent No.: US 8,081,914 B2
(45) Date of Patent: Dec. 20, 2011

(54) APPARATUS AND METHOD FOR DETACHING MEDIA FROM A FUSER IN A PRINTER

(75) Inventors: Erwin Ruiz, Rochester, NY (US); Cheng-Ning Jong, North Chili, NY (US); Martin Oksenhorn, Fairport, NY (US); Richard C. Dray, Rochester, NY (US); Robert Mark Jacobs, Ontario, NY (US)

(73) Assignee: Xerox Corporation, Norwalk, CT (US)

( * ) Notice: Subject to any disclaimer, the term of this patent is extended or adjusted under 35 U.S.C. 154(b) by 375 days.

(21) Appl. No.: 12/353,629

(22) Filed: Jan. 14, 2009

(65) Prior Publication Data

US 2010/0178086 A1 Jul. 15, 2010

(51) Int. Cl.
*G03G 15/20* (2006.01)

(52) U.S. Cl. ..... 399/323; 399/68; 399/322; 399/400

(58) Field of Classification Search ..... 399/68, 399/322, 323, 400
See application file for complete search history.

(56) References Cited

U.S. PATENT DOCUMENTS 3,955,813 A * 5/1976 Edwards ..... 399/323
5,459,562 A 10/1995 Mitsuya et al.
6,002,913 A 12/1999 Pawlik et al.
6,259,888 B1 * 7/2001 Kazama et al. ..... 399/406
6,844,937 B2 1/2005 Dempsey et al.
2004/0120735 A1 6/2004 Baba et al.
2005/0156377 A1 7/2005 Jacobs
2007/0206981 A1 9/2007 Amico et al.
2008/0193176 A1 8/2008 Roof

FOREIGN PATENT DOCUMENTS

EP 1959315 A1 8/2008
JP 58007167 A 1/1983

OTHER PUBLICATIONS

European Search Report mailed May 18, 2010 in Connection with related EP Application No. 10150464.5.

* cited by examiner

*Primary Examiner* — Ryan Walsh
(74) *Attorney, Agent, or Firm* — Ronald E. Prass, Jr.; Prass LLP

(57) ABSTRACT

An apparatus (100) and method (200) that detaches media from a fuser in a printer is disclosed. The method can include feeding (220) a media sheet through a fuser member and applying (230) gas from an air knife to the media sheet on the fuser member to detach the media sheet at a detach point from the fuser member. The method can also include asserting (240) tension on the media sheet using a set of rotational members and continuing to apply gas from the air knife to the media sheet until the set of rotational members asserts tension on the media sheet.

20 Claims, 5 Drawing Sheets

APPARATUS AND METHOD FOR DETACHING MEDIA FROM A FUSER IN A PRINTER

BACKGROUND

Disclosed herein is an apparatus and method that detaches media from a fuser in a printer.

Presently, fusers are used in image generation devices, such as printers, to fuse a latent image on media, such as a document, by applying pressure and heat to the image on the document. When the fused document exits the fuser, the document may stick to the fuser roll. Some devices use stripper fingers to strip the document from the fuser roll. Unfortunately, the stripper fingers can cause a mottle look on the document where the fingers contact the document when stripping it from the fuser roll.

Other devices use air knives to strip the document from the fuser roll. An air knife or a plurality of air knives strip a document from a fuser roll by blowing pressurized gas between the document and the fuser roll to strip the document at or close to a fuser roll nip. This can result in a smooth looking fused image on the document. This can also result in the document bouncing around in the air knife baffle, creating slag with the document waving or flopping around in the air knife baffle chamber.

After initially stripping the lead edge of the document off the fuser roll, the air knife system shuts off and the document self strips off the fuser roll in the air knife baffle. At this point, the striping function relies on the document stiffness to continue the self stripping. This change in stripping function changes the strip point location of the document relative to the fuser roll because part of the document re-tacks to the fuser roll. Different document strip points create image quality defects showing a visible transition in solids resulting from the air turning off. Furthermore, the document sheet may take a curved trajectory after being stripped before the lead edge is in a decurler exit nip causing the document sheet to buckle. If there is a buckle after the air knife is turned off, the sheet strip point moves away from the fuser nip, further causing image quality defects.

As mentioned, the image quality defects are evidenced by a difference between a smooth image appearance and a mottle image appearance on the document. For example, if the document is stripped closer to the fuser nip, the resulting image is smoother. If the document is stripped at a location after the nip, the resulting image has a mottle look. In documents that use coated media, the transition from smooth to mottle is especially noticeable to customers, which is evidenced by maintenance requests precipitated by image quality defect.

One approach to eliminate or limit the image quality defect is to leave the air knife on while the whole document sheet passes through the fuser. This requires a higher air knife pressure capacity, which requires a bigger compressor. Unfortunately, a bigger compressor is more costly, requires more power, requires major hardware changes, and results in higher noise levels. Furthermore, excessive use of air knives excessively cools the fuser roll. Also, excessive use of air knives cause streaks created by the air jets on some coated documents. Additionally, air knives can cause air streaks due to an interaction of air temperature and document corrugation. For example, multiple air knives blow air under the document at certain points creating ridges, but the document still sticks a bit to fuser at other points creating grooves, thus wrinkling the document.

Thus, there is a need for an improved apparatus and method that detaches media from a fuser in a printer.

SUMMARY

An apparatus and method that detaches media from a fuser in a printer is disclosed. The method can include feeding a media sheet through a fuser member and applying gas from an air knife to the media sheet on the fuser member to detach the media sheet at a detach point from the fuser member. The method can also include asserting tension on the media sheet using a set of rotational members and continuing to apply gas from the air knife to the media sheet until the set of rotational members asserts tension on the media sheet.

BRIEF DESCRIPTION OF THE DRAWINGS

In order to describe the manner in which advantages and features of the disclosure can be obtained, a more particular description of the disclosure briefly described above will be rendered by reference to specific embodiments thereof which are illustrated in the appended drawings. Understanding that these drawings depict only typical embodiments of the disclosure and are not therefore to be considered to be limiting of its scope, the disclosure will be described and explained with additional specificity and detail through the use of the accompanying drawings in which.

DETAILED DESCRIPTION

The embodiments include a method in a printing apparatus including a fuser member, an air knife, and a set of rotational members. The method can include feeding a media sheet through the fuser member. The method can also include applying gas from the air knife to the media sheet on the fuser member to detach the media sheet at a detach point from the fuser member. The method can also include asserting tension on the media sheet using the set of rotational members. The method can also include continuing to apply gas from the air knife to the media sheet until the set of rotational members asserts tension on the media sheet.

The embodiments further include apparatus useful for printing. The apparatus can include a fuser member configured to contact a media sheet to fuse marking material on the media sheet. The apparatus can also include an air knife configured to apply gas to the media sheet to detach the media sheet from the fuser member at a fuser member detach point. The apparatus can also include a set of rotational members configured to assert tension on the media sheet prior to ceasing applying gas from the air knife to the media sheet.

The embodiments further include a method in a printing apparatus including a fuser member, an air knife, and a decurler. The method can include feeding a media sheet through the fuser member. The method can also include applying gas from the air knife to the media sheet on the fuser member to detach the media sheet at a detach point from the fuser member. The method can also include receiving the media sheet at the decurler. The method can also include accelerating a rotational speed of the decurler to assert tension on the media sheet while a portion of the media sheet is still in the fuser member. The method can also include continuing to apply gas from the air knife to the media sheet until the decurler asserts tension on the media sheet. The method can also include ceasing applying gas from the air knife to the media sheet after the decurler asserts tension on the media sheet. The method can also include decelerating the rotational speed of the decurler after asserting tension on the media sheet while the media sheet is still in the fuser member.

Figure 1:
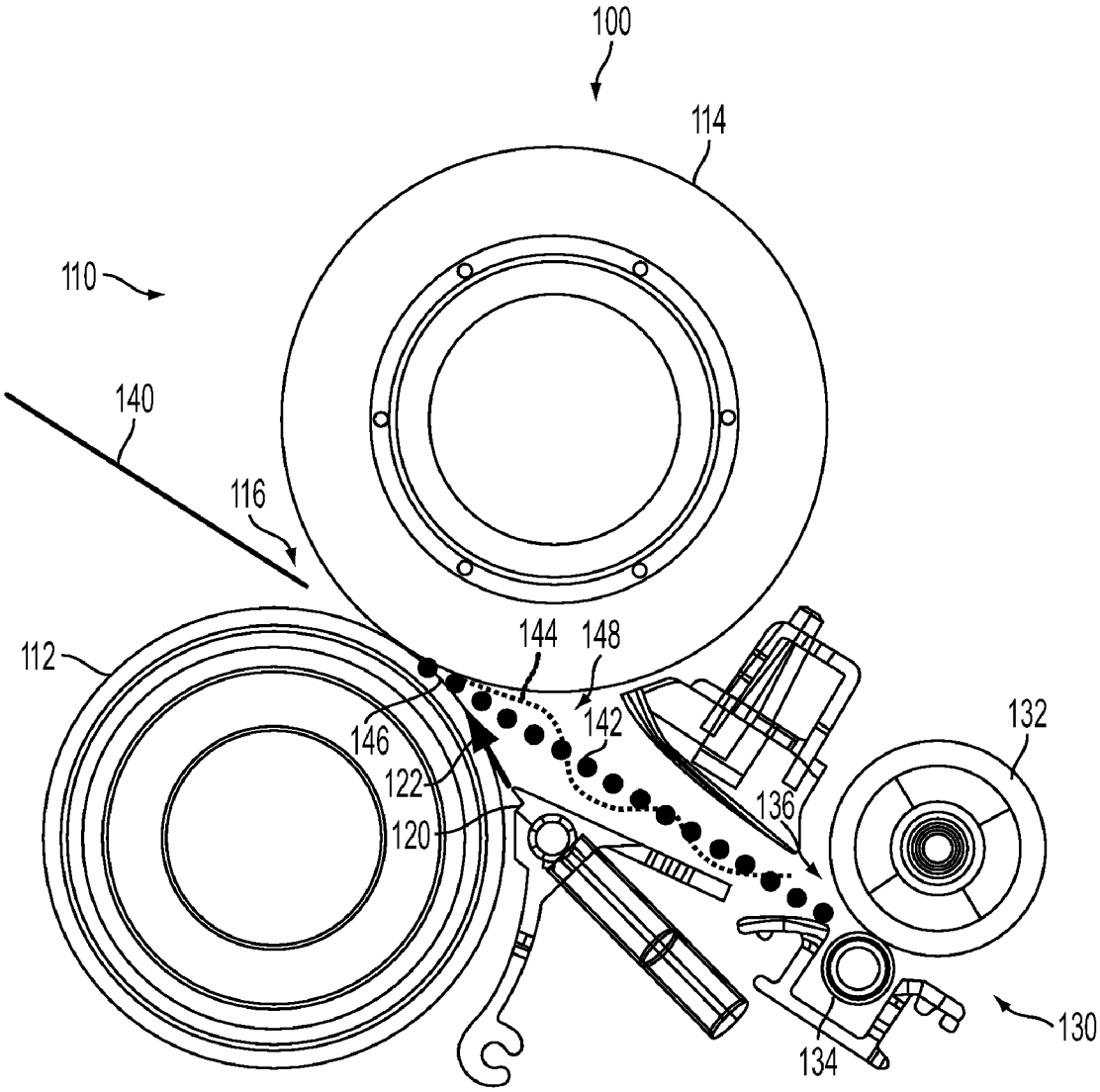
FIG. 1 is an exemplary illustration of an apparatus.

FIG. 1 is an exemplary illustration of an apparatus 100. The apparatus 100 may be a part of a printer, a multifunction media device, a xerographic machine, an ink jet printer, a laser jet printer, or any other device that generates an image on media. The apparatus 100 can include a fuser member 110 configured to contact a media sheet 140 to fuse marking material on the media sheet 140. The fuser member 110 can include a rotational fuser member 112 rotationally supported in the apparatus 100 and a pressure member 114 rotationally supported in the apparatus 100, where the pressure member 114 can assert pressure against the fuser member 112 at a fuser nip 116. The rotational fuser member 112 and/or the pressure member 114 can be a roll, a belt, or any other member that can be rotationally supported in an apparatus.

The apparatus 100 can include an air knife 120 configured to apply gas 122 to the media sheet 140 to detach the media sheet 140 from the fuser member 110 at a fuser member detach point 146. The air knife 120 may include a fluid pathway which connects an associated source of pressurized gas. The air knife can also include at least one orifice adjacent to the fuser member 110, where the orifice can be configured to expel the pressurized gas 122 from the source of pressurized gas.

The apparatus 100 can include a set of rotational members 130 configured to assert tension on the media sheet 140 prior to ceasing applying gas 122 from the air knife 120 to the media sheet 140. The set of rotational members 130 can be a decurler 130 that can include a first decurler member 132 rotationally supported in the apparatus 100 and a second decurler member 134 rotationally supported in the apparatus 100, where the first decurler member 132 can be coupled to the second decurler member 134 at a decurler nip 136. For illustrative purposes, the embodiments will be described with respect to a decurler, but it is understood that the embodiments can use any set of rotational members, such as rotational members for an inverter, rotational members for a document stacker, rotational members dedicated to applying embodiments of this disclosure, or any other set of rotational members that can assert tension on a media sheet. For example, the decurler 130 or other rotational members can perform double duty of operating according to their traditional operation while also applying tension on the media sheet according to the disclosed embodiments. The first decurler member 132 and/or the second decurler member 134 can be a roll, a belt, or any other member that can be rotationally supported in an apparatus. The decurler 130 can be configured to assert tension on the media sheet 140 to ensure that the media sheet 140 detaches at substantially the same detach point on the fuser member 110 using the decurler 130 as the fuser member detach point 146 using the air knife 120. The air knife 120 can be configured to cease applying gas 122 to the media sheet 140 after the decurler 130 asserts tension on the media sheet 140.

The decurler 130 can be configured to assert tension by accelerating a rotational speed of the decurler 130 to assert tension on the media sheet 140 after receiving the media sheet 140 at the decurler 130 while a portion of the media sheet 140 is still in the fuser member 110. For example, the decurler rotational speed can be increased to assert media sheet tension 142 and reduce media sheet slag 144 as fast as possible. The air knife 120 can be left on until the slag 144 is reduced to make sure the media sheet 140 does not retack or restick onto the fuser member 110. The air knife 120 can shut off after the decurler 130 asserts tension on the media sheet 140. The decurler 130 can be configured to decelerate its rotational speed after asserting tension on the media sheet 140. For example, the decurler 130 can be decelerated after reducing slag to reduce wear on a decurler roll, such as the first or second decurler members 132 and 134, and/or to avoid smears or scratches on an image on the media sheet 140. The rotational speed of the decurler 130 can be reduced to a point that is slightly faster than a speed of the fuser member 110 to keep tension on and reduce slag of the media sheet 140 in an area, such as in an air knife baffle, 148 between the fuser member 110 and the decurler 130. The actual relative speeds of the fuser member 110, the decurler 130, an inverter (not shown), and other elements can be based on ratios based on geometry and operational relationships between elements of the apparatus 100 according to desired operation.

The decurler 130 can be configured to decelerate its rotational speed after asserting tension on the media sheet 140 to reduce trail edge curl of the media sheet 140. For example, if the rotational speed of the decurler 130 provides too much tension on the media sheet 140 while the media sheet 140 is still in the fuser member 110, the extra tension can cause a trail edge of the media sheet 140 to curl. Thus, the decurler 130 can maintain an appropriate tension on the media sheet 140 to maintain tension on the media sheet 140 while avoiding trail edge curl of the media sheet 140.

The decurler 130 can also be configured to accelerate its rotational after the media sheet 140 exits the fuser member 110. For example, the rotational speed of the decurler 130 can accelerate after a trail edge of the media sheet 140 exits the fuser member 110 to transfer the media sheet 140 to a next station in the apparatus 100. The decurler 130 can maintain this speed until the media sheet 140 leaves the decurler 130. The decurler 130 can also maintain this speed or reduce the speed until the lead edge of a next media sheet 140 reaches the decurler 130. The decurler 130 may operate at one accelerated speed and one decelerated speed for all operations or may operate at different accelerated and/or decelerated speeds depending on desired operation.

Gas can be applied from the air knife 120 to the media sheet 140 and tension can be asserted by the decurler 130 on the media sheet 140 while the media sheet 140 is still in the fuser member 110 to maintain constant image quality of the media sheet 140. For example, the timing of different speeds of the decurler 130 and the timing of application of gas by the air knife 120 can be set to avoid image quality defects on the media sheet 140. Thus, an image on the media sheet 140 can look better and more consistent because the media sheet 140 is detached at a consistent location 146 on the fuser member 110 relative to the fuser member nip 116.

The apparatus 110 can determine a media sheet type is subject to differential image quality defects that result from detaching the media sheet 140 from the fuser member 110 in different manners and/or at different points on the fuser member 110. Tension may be asserted on the media sheet 140 using the decurler 130 prior to ceasing applying gas 122 from the air knife 120 to the media sheet 140 only if the media sheet type is subject to differential image quality defects. For example, a decurler acceleration and deceleration profile can be run only when a user selects media that could have the defects. After selecting the media, software can control air knife solenoid pressure in order to keep the pressure on long enough until the decurler 130 eliminates the document slack.

This can ensure that the document will strip at the same point on the fuser member 110. Alternately, the apparatus 100 can operate according to some embodiments without determining whether a media sheet type is subject to differential image quality defects.

Thus, a media sheet, such as a document, can be accelerated in the decurler 130 to maintain the document in tension right before the air knife 120 is turned off. By maintaining the document in tension, the document can maintain substantially the same strip point position 146 on the whole fuser member 110 and the document does not retack to the fuser member 110, which can eliminate gloss and mottle differential defects. Once the document is off the fuser member 110, the decurler 130 can reduce its speed in order to avoid any unwanted dysfunction, such as curl, on the document. For example, document trail edge curl can be a function of decurler speed. Trial edge curl can increase if decurler speed increases. Ideally, the decurler speed may be kept as slow as possible to avoid trail edge curl. Embodiments can increase decurler speed at some times to avoid image quality defects, while decreasing decurler speed at other times to avoid trail edge curl.

Figure 2:
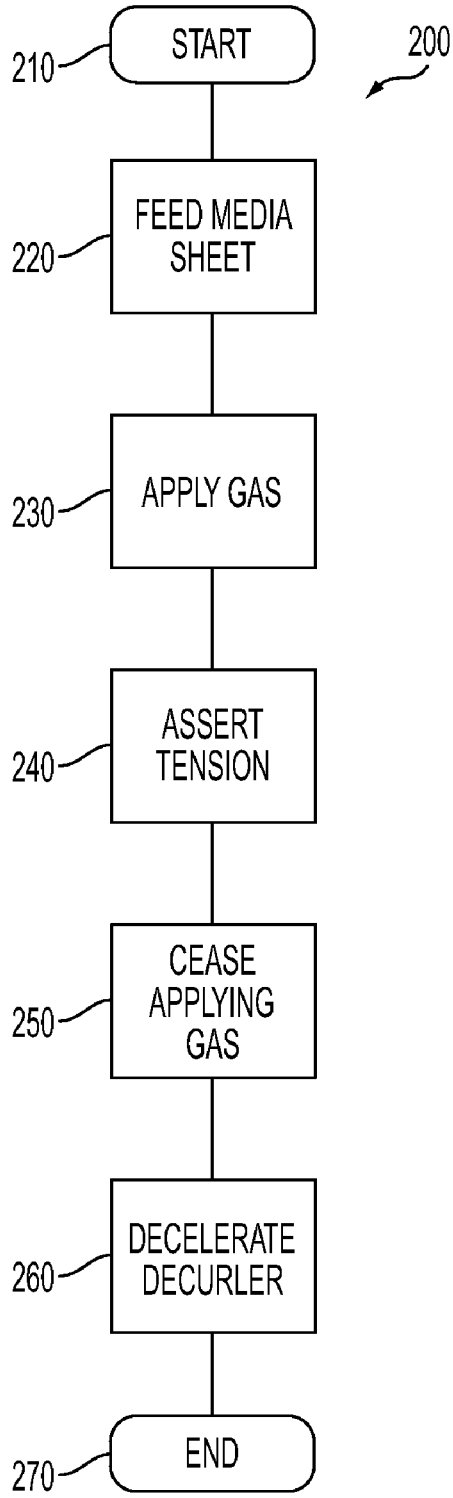
FIG. 2 illustrates an exemplary flowchart of a method in a printing apparatus.

FIG. 2 illustrates an exemplary flowchart 200 of a method in a printing apparatus including a fuser member, an air knife, and a decurler. The method starts at 210. At 220, a media sheet is fed through the fuser member. At 230, gas is applied from the air knife to the media sheet on the fuser member to detach the media sheet at a detach point from the fuser member. At 240, tension is asserted on the media sheet using the decurler. The tension can be asserted when the media sheet is received at the decurler. The decurler can assert tension by accelerating the rotational speed of the decurler to assert tension on the media sheet after receiving the media sheet at the decurler while a portion of the media sheet is still in the fuser member. The air knife can continue to apply gas to the media sheet until the decurler asserts tension on the media sheet. For example, gas can be applied from the air knife to the media sheet on the fuser member to disengage the media sheet at a detach point from the fuser member. The decurler can assert tension on the media sheet to ensure that the media sheet detaches at substantially the same detach point on the fuser member using the decurler as the detach point on the fuser member using the air knife. At 250, the air knife ceases to apply gas to the media sheet after the decurler asserts tension on the media sheet. Thus, the decurler can assert tension on the media sheet prior to ceasing applying gas from the air knife to the media sheet.

For example, the decurler rotational speed can be increased to reduce media sheet slag as fast as possible. The air knife can be left on until the slag is reduced to make sure the media sheet does not retack onto the fuser member. The air knife can be shut off after the decurler asserts tension on the media sheet.

At 260, the rotational speed of the decurler can be decelerated after asserting tension on the media sheet. The rotational speed of the decurler can be decelerated after asserting tension on the media sheet to reduce trail edge curl of the media sheet. For example, if the rotational speed of the decurler provides too much tension on the media sheet while the media sheet is still in the fuser member, the extra tension can cause the trail edge of the media sheet to curl. The decurler can be decelerated after reducing slag on the media sheet, to reduce wear on the decurler roll, and/or to avoid smears or scratches on an image on the media sheet. The rotational speed of the decurler can be reduced to a point that is slightly faster than the fuser member to keep tension on and to reduce slag of the media sheet. The rotational speed of the decurler can be accelerated after the media sheet exits the fuser member. For example, the rotational speed of the decurler can be accelerated after a trail edge of the media sheet exits the fuser member to transfer the media sheet to the next station or to match the speed of an inverter. The decurler can maintain this speed until the media sheet leaves the decurler. The decurler can also maintain this speed or reduce the speed until the lead edge of the next media sheet reaches the decurler. The decurler may operate at one accelerated speed and one decelerated speed for all operations or may operate at different accelerated and/or decelerated speeds depending on desired operation. The actual relative speeds of the fuser member, the decurler, an inverter, and other elements can be based on ratios based on geometry and operational relationships between elements according to desired operation.

Gas can applied from the air knife to the media sheet and tension can be asserted by the decurler on the media sheet while the media sheet is still in the fuser member to maintain constant image quality of the media sheet. For example, the timing of different speeds of the decurler and the timing of application of gas by the air knife can be set to avoid image quality defects on the media sheet. Thus, an image on the media sheet can look better and more consistent because the media sheet is detached at a consistent location on the fuser member relative to the fuser member nip point. At 270, the method ends.

Figure 3:
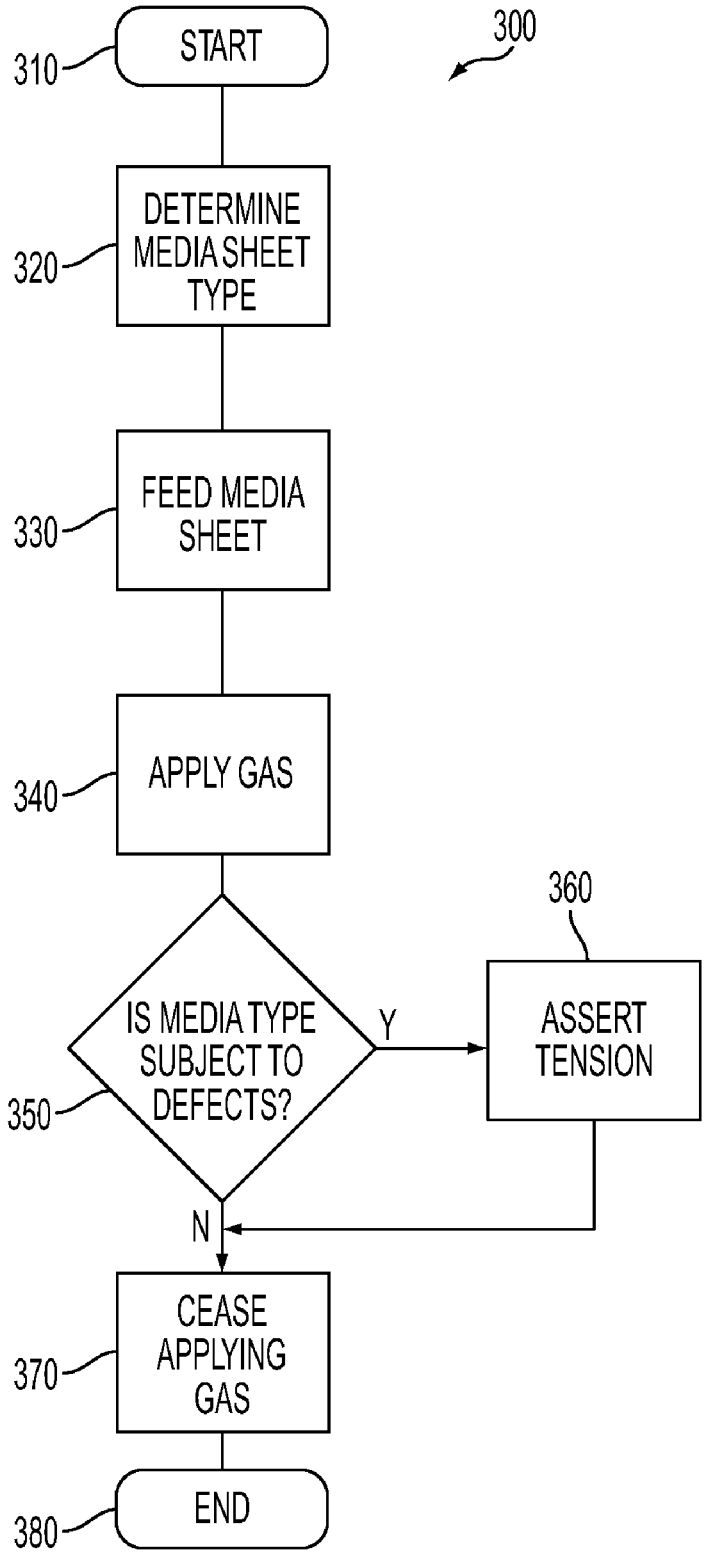
FIG. 3 illustrates an exemplary flowchart of a method in a printing apparatus.

FIG. 3 illustrates an exemplary flowchart 300 of a method in a printing apparatus including a fuser member, an air knife, and a decurler. The flowchart 300 can be used in conjunction with elements from the flowchart 200. At 310, the flowchart 300 begins. At 320, a media sheet type is determined. For example, information regarding the media sheet type, such as whether the media sheet is coated or the weight or size of the media sheet, can be input by a user and/or determined by elements of a printing apparatus. At 330, a media sheet is fed through the fuser member. At 340, gas is applied from the air knife to the media sheet on the fuser member to detach the media sheet at a detach point from the fuser member. At 350 a decision is made based on whether the media sheet type is subject to differential image quality defects, where the differential image quality defects result from detaching the media sheet from the fuser member. If the media sheet type is subject to differential image quality defects, at 360, tension is asserted on the media sheet using the decurler prior to ceasing applying gas from the air knife to the media sheet only if the media sheet type is subject to differential image quality defects. At 370, the air knife ceases to apply gas to the media sheet. At 380, the method ends.

Figure 4:
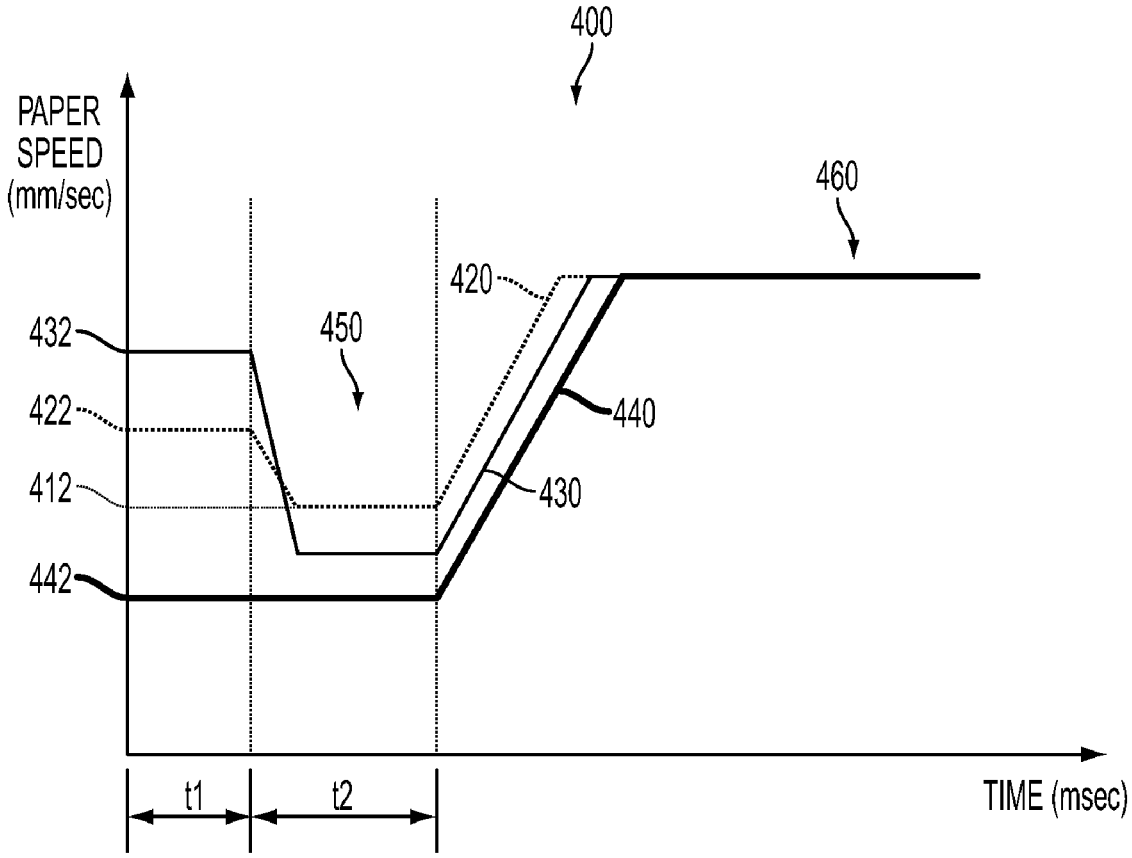
FIG. 4 is an exemplary graph illustrating the operation of the apparatus.

FIG. 4 is an exemplary graph illustrating the operation of the apparatus 100 according to one embodiment. At 442, some elements of the apparatus 100 can feed a media sheet at a given speed, such as 596 mm/s, through time t1 and t2. After time t2, the media sheet can be accelerated to another speed 460, such as 1020 mm/s, to match the speed of an inverter. Traditionally, a decurler can operate a little faster at 412, such as at 638 mm/s, than a fuser, which does not sufficiently reduce slag or slack of the media sheet 140, and the decurler can then increase its speed at 440 to the speed at 460 to match an inverter. However, according to some present embodiments, the decurler 130 can operate at an accelerated speed at 422, such as at 695 mm/s, to reduce slag of the media sheet 140 after its leading edge has exited the fuser member 110 and entered the decurler 130. After the decurler 130 has reduced or eliminated the slag during time t1, the decurler 130 can decelerate at 450 during time t2 to avoid curling the trailing edge of the media sheet 140 while it is still in the fuser member 110. After time t2, when the media sheet 140 exits the fuser member 110, the decurler 130 can accelerate at 420 to a speed at 460, such as 1020 mm/s, to match the speed of an inverter. If no inverter is used, the decurler 130 can instead accelerate back to the speed at 422 to be ready to reduce the slag of a next media sheet. Other speeds can be used to optimize results. For example, the decurler can operate at a faster speed at 432 to eliminate media sheet slag faster during t1, then decelerate to a slower speed during t2 and at 450 to further avoid media sheet trail edge curl, and then accelerate at 430 after t2 to a faster speed at 460 to match an inverter.

Figure 5:
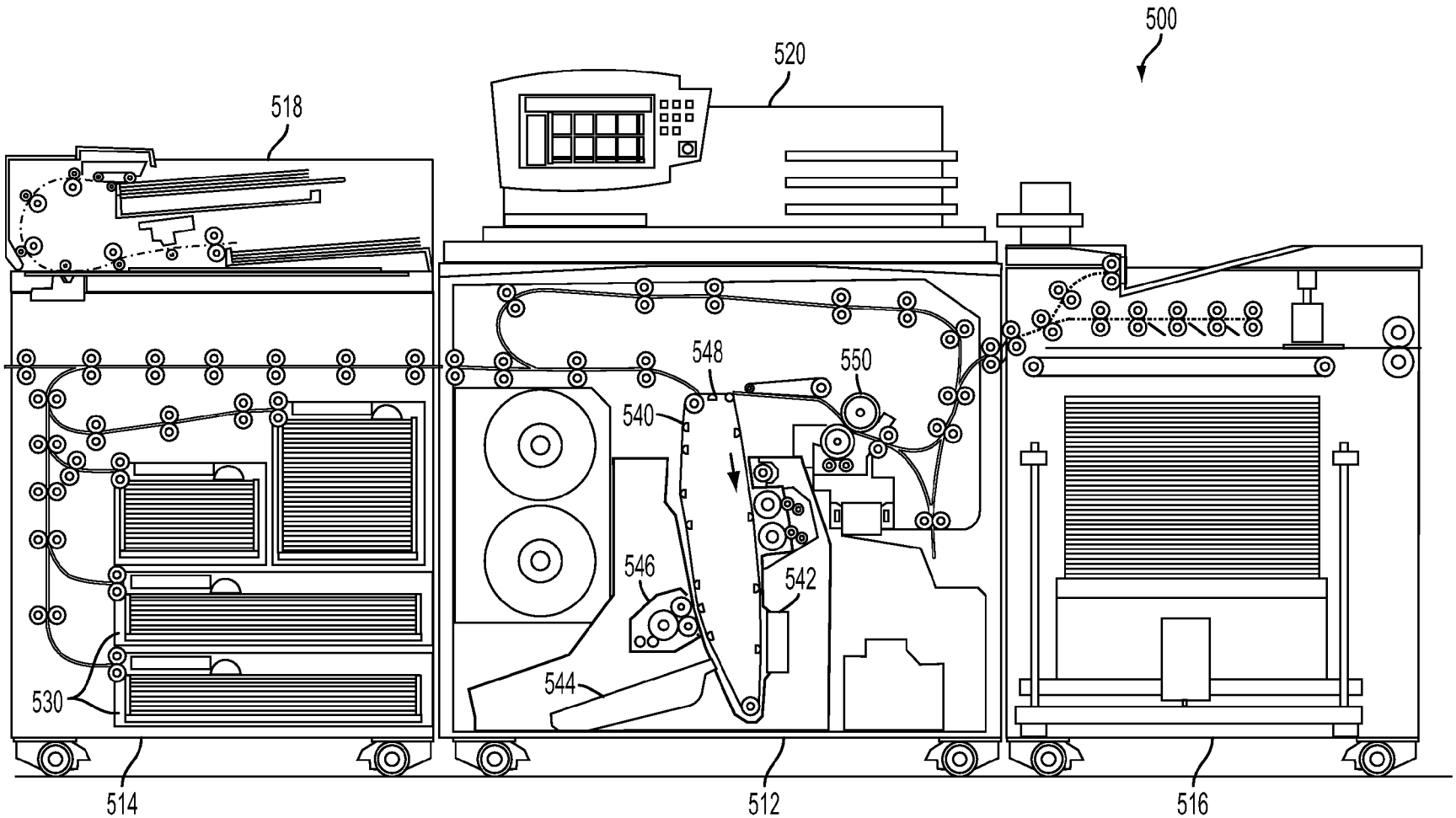
FIG. 5 illustrates an exemplary printing apparatus.

FIG. 5 is an exemplary diagram of an image production device 500, such as the apparatus 100, in accordance with one possible embodiment of the disclosure. The image production device 500 may be any device, such as a copier, a printer, a facsimile device, a multi-function device, or other device that may be capable of making image production documents, such as printed documents, copies, and/or other image production documents.

The image production device 500 can include a marking engine 512, which can include hardware by which image signals are used to create a desired image. The image production device 500 can include a feeder module 514, which can store and dispense sheets on which images are to be printed. The image production device 500 can include a finisher 516, which may include hardware for stacking, folding, stapling, binding, and/or otherwise finishing prints which are output from the marking engine 512. If the image production device 500 is also operable as a copier or multifunction device, the image production device 500 can include a document feeder 518, which can operate to convert signals from light reflected from original hard-copy image into digital signals, which can be processed to create copies with the marking engine 512. The image production device 500 may also include a local user interface 520 for controlling its operations, although another source of image data and instructions may include any number of computers connected to the image production device 500 via a network.

The feeder module 514 can include any number of trays 530, each of which can store media sheets of a selected stock or type, such as size, weight, color, coating, and/or transparency. Sheets drawn from a selected tray 530 are moved to the marking engine 512 to receive one or more images thereon.

The marking engine 512 can be any marking engine, such as monochrome xerographic, color xerographic, ionographic, inkjet, or other marking engine. The marking engine 512 can include a photoreceptor 540, here in the form of a rotatable belt. The photoreceptor 540 is an example of what can be called a rotatable image receptor, meaning any rotatable structure such as a drum or belt which can temporarily retain one or more images for printing. Such an image receptor can comprise, by way of example and not limitation, a photoreceptor, or an intermediate member for retaining one or more ink, toner, or other marking material layers for subsequent transfer to a media sheet. The photoreceptor 540 can be entrained on a number of rollers, and a number of stations can be placed suitably around the photoreceptor 540. Such stations can include a charging station 542, an imaging station 544, a development station 546, and a transfer station 548. In an example embodiment, the imaging station 544 can be a laser-based raster output scanner in which a narrow laser beam scans successive scan lines oriented perpendicular to the process direction of the rotating photoreceptor 540. The laser can be turned on and off to selectively discharge small areas on the moving photoreceptor 540 according to image data to yield an electrostatic latent image, which can be developed with toner or other marking material at the development station 546 and transferred to a sheet at transfer station 548.

A sheet having received an image in this way can be subsequently moved through a fuser 550, such as the fuser member 110, and the heat and/or pressure from the fuser 550 can cause the toner image to become substantially permanent on the media sheet. For duplex or two-sided printing, the printed sheet can then be inverted and re-fed through the transfer station 548 to receive a second-side image. The finally-printed sheet can then be moved to finisher module 516, where it may be collated, stapled, folded, and/or otherwise finished with other media sheets.

Although the above description is directed toward a fuser member, such as a fuser used in xerographic printing, it will be understood that the teachings and claims herein can be applied to any treatment of marking material on a medium. For example, the marking material may comprise liquid or gel ink, and/or heat- or radiation-curable ink; and/or the medium itself may have certain requirements, such as temperature, for successful printing. The heat, pressure and other conditions required for treatment of the ink on the medium in a given embodiment may be different from those suitable for xerographic fusing.

Embodiments can provide for smoother image appearance and better image resolution. Embodiments can also reduce or eliminate distortion, such as mottle finish, on an image on media. For example, a more mottle appearance can occur the longer an image on media stays on a fuser during stripping. According to some embodiments, the document is stripped right at the fuser nip, which results in less time of the document on the fuser, which results in better image quality. Some embodiments eliminate a need for special hardware otherwise required to improve image quality. Some embodiments also eliminate a need for continuous use of an air knife. This can eliminate the need for a large compressor and can help to avoid overheating an air knife solenoid, which can improve duty cycles. Embodiments can also provide for an additional velocity of a decurler, which can reduce potential curl effect on a document. The additional velocity of the decurler can also reduce potential wear on the decurler.

For example, embodiments address the image quality defect problem by first running a decurler exit nip at a higher velocity than normal to remove document buckle and then slowing down to a normal exit speed in conjunction with turning off the air knife. This can keep a document strip point constant over the length of the media sheet and can eliminate the image quality defect. A velocity profile can be used on the exit nip along with air knife control to keep the strip point constant. This can provide for a lower cost compressor and can avoid streaks caused by fuser roll cooling from the air knife.

Some embodiments can be implemented on a programmed processor. However, the embodiments may also be implemented on a general purpose or special purpose computer, a programmed microprocessor or microcontroller and peripheral integrated circuit elements, an integrated circuit, a hardware electronic or logic circuit such as a discrete element circuit, a programmable logic device, or the like. In general, any device on which resides a finite state machine capable of implementing the embodiments may be used to implement the processor functions of this disclosure.

While this disclosure has been described with specific embodiments thereof, it is evident that many alternatives, modifications, and variations will be apparent to those skilled in the art. For example, various components of the embodiments may be interchanged, added, or substituted in the other embodiments. Also, all of the elements of each figure are not necessary for operation of the embodiments. For example, one of ordinary skill in the art of the embodiments would be enabled to make and use the teachings of the disclosure by simply employing the elements of the independent claims. Accordingly, the preferred embodiments of the disclosure as set forth herein are intended to be illustrative, not limiting. Various changes may be made without departing from the spirit and scope of the disclosure.

In this document, relational terms such as "first," "second," and the like may be used solely to distinguish one entity or action from another entity or action without necessarily requiring or implying any actual such relationship or order between such entities or actions. Also, relational terms, such as "top," "bottom," "front," "back," "horizontal," "vertical," and the like may be used solely to distinguish a spatial orientation of elements relative to each other and without necessarily implying a spatial orientation relative to any other physical coordinate system. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "a," "an," or the like does not, without more constraints, preclude the existence of additional identical elements in the process, method, article, or apparatus that comprises the element. Also, the term "another" is defined as at least a second or more. The terms "including," "having," and the like, as used herein, are defined as "comprising."

We claim:

1. A method in a printing apparatus including a fuser member, an air knife, and a set of rotational members, the method comprising:

feeding a media sheet through the fuser member;

applying gas from the air knife to the media sheet on the fuser member to detach the media sheet at a detach point from the fuser member;

asserting tension on the media sheet using the set of rotational members; and continuing to apply gas from the air knife to the media sheet until the set of rotational members asserts tension on the media sheet, wherein the method further comprises receiving the media sheet at the set of rotational members, wherein asserting tension comprises accelerating the rotational members to assert tension on the media sheet after a media sheet leading edge has exited the fuser member, and wherein the method further comprises decelerating the rotational members after asserting tension on the media sheet while the media sheet is still in the fuser member.

2. The method according to claim 1, wherein asserting comprises asserting tension on the media sheet using the set of rotational members to ensure that the media sheet detaches at substantially the same detach point on the fuser member using the set of rotational members as the detach point on the fuser member using the air knife.

3. The method according to claim 1, wherein the set of rotational members comprises a decurler, and wherein the method further comprises ceasing applying gas from the air knife to the media sheet after the decurler asserts tension on the media sheet.

4. The method according to claim 3, wherein asserting comprises asserting tension on the media sheet using the decurler prior to ceasing applying gas from the air knife to the media sheet.

5. The method according to claim 1, further comprising:

determining a media sheet type is subject to differential image quality defects, the differential image quality defects resulting from detaching the media sheet from the fuser member; and asserting tension on the media sheet using the set of rotational members prior to ceasing applying gas from the air knife to the media sheet only if the media sheet type is subject to differential image quality defects.

6. The method according to claim 1, wherein asserting tension comprises accelerating a rotational speed of the set of rotational members to assert tension on the media sheet after receiving the media sheet at the set of rotational members while a portion of the media sheet is still in the fuser member.

7. The method according to claim 6, further comprising decelerating a rotational speed of the set of rotational members after asserting tension on the media sheet.

8. The method according to claim 7, further comprising decelerating a rotational speed of the set of rotational members after asserting tension on the media sheet to reduce trail edge curl of the media sheet.

9. The method according to claim 7, further comprising accelerating a rotational speed of the set of rotational members after the media sheet exits the fuser member.

10. The method according to claim 1, wherein gas is applied from the air knife to the media sheet and tension is asserted by the set of rotational members on the media sheet while the media sheet is still in the fuser member to maintain constant image quality of the media sheet.

11. An apparatus useful for printing comprising:

a fuser member configured to contact a media sheet to fuse marking material on the media sheet;

an air knife configured to apply gas to the media sheet to detach the media sheet from the fuser member at a fuser member detach point; and a set of rotational members configured to assert tension on the media sheet prior to ceasing applying gas from the air knife to the media sheet, wherein the rotational members operate at an accelerated speed to assert tension on the media sheet after a media sheet leading edge has exited the fuser member, and wherein the rotational members operate at a decelerated speed after asserting tension on the media sheet while the media sheet is still in the fuser member.

12. The apparatus according to claim 11, wherein the fuser member comprises a rotational fuser member rotationally supported in the apparatus and a pressure member rotationally supported in the apparatus, where the pressure member asserts pressure against the fuser member.

13. The apparatus according to claim 11, wherein the set of rotational members comprises a decurler including a first decurler member rotationally supported in the apparatus and a second decurler member rotationally supported in the apparatus, the first decurler member coupled to the second decurler member.

14. The apparatus according to claim 11, wherein the set of rotational members is configured to assert tension on the media sheet to ensure that the media sheet detaches at substantially the same detach point on the fuser member using the set of rotational members as the fuser member detach point using the air knife.

15. The apparatus according to claim 11, wherein the air knife is configured to cease applying gas to the media sheet after the set of rotational members asserts tension on the media sheet.

16. The apparatus according to claim 11, wherein the set of rotational members is configured to assert tension by accelerating a rotational speed of the set of rotational members to assert tension on the media sheet after receiving the media sheet at the set of rotational members while a portion of the media sheet is still in the fuser member.

17. The apparatus according to claim 16, wherein the set of rotational members is configured to decelerate its rotational speed after asserting tension on the media sheet.

18. The apparatus according to claim 17, further wherein the set of rotational members is configured to accelerate its rotational after the media sheet exits the fuser member.

19. A method in a printing apparatus including a fuser member, an air knife, and a decurler, the method comprising:

feeding a media sheet through the fuser member;

applying gas from the air knife to the media sheet on the fuser member to detach the media sheet at a detach point from the fuser member;

receiving the media sheet at the decurler, accelerating a rotational speed of the decurler to assert tension on the media sheet while a portion of the media sheet is still in the fuser member;

continuing to apply gas from the air knife to the media sheet until the decurler asserts tension on the media sheet;

ceasing applying gas from the air knife to the media sheet after the decurler asserts tension on the media sheet; and decelerating the rotational speed of the decurler after asserting tension on the media sheet while the media sheet is still in the fuser member.

20. The method according to claim 19, wherein decelerating further comprises decelerating the rotational speed of the decurler to reduce trail edge curl of the media sheet.

* * * * *